US012679509B2

(12) United States Patent
Lee et al.

(10) Patent No.: US 12,679,509 B2
(45) Date of Patent: Jul. 14, 2026

(54) METHOD FOR ACQUIRING LOCATION INFORMATION OF OBSERVATION BUOY REFLECTING INFLUENCE OF OCEAN CURRENT AND METHOD FOR ASSESSING DAMAGE RISK RELATING TO SPILLED OIL DISPERSION OF SUNKEN SHIP BY USING SAME LOCATION INFORMATION

(71) Applicant: KOREA INSTITUTE OF OCEAN SCIENCE & TECHNOLOGY, Busan (KR)

(72) Inventors: Moonjin Lee, Daejeon (KR); Tae Sung Kim, Daejeon (KR); Yong Myung Kim, Daejeon (KR)

(73) Assignee: KOREA INSTITUTE OF OCEAN SCIENCE & TECHNOLOGY, Busan (KR)

( * ) Notice: Subject to any disclaimer, the term of this patent is extended or adjusted under 35 U.S.C. 154(b) by 319 days.

(21) Appl. No.: 18/408,959

(22) Filed: Jan. 10, 2024

(65) Prior Publication Data

US 2024/0140561 A1 May 2, 2024

Related U.S. Application Data

(63) Continuation of application No. PCT/KR2022/014210, filed on Sep. 22, 2022.

(30) Foreign Application Priority Data

Sep. 27, 2021 (KR) ..... 10-2021-0127356

(51) Int. Cl.
*B63B 22/00* (2006.01)

(52) U.S. Cl.
CPC ..... *B63B 22/00* (2013.01); *B63B 2022/006* (2013.01); *B63B 2211/02* (2013.01)

(58) Field of Classification Search
CPC ..... B63B 22/00; B63B 2022/006; B63B 2211/02
See application file for complete search history.

(56) References Cited

U.S. PATENT DOCUMENTS

2013/0144577 A1* 6/2013 Kazama ..... G06F 30/20 703/2
2019/0362035 A1* 11/2019 Jeschke ..... G06T 13/60
2022/0404507 A1* 12/2022 Lee ..... B63B 22/18

FOREIGN PATENT DOCUMENTS

CN 103770911 A * 5/2017
JP 6794540 B2 * 12/2020 ..... H04B 1/04
(Continued)

OTHER PUBLICATIONS

Lee Moonjin, Kim Hye-Jin: "A Study on the Pollution Risk Assessment of Oil Spill Accidents", Journal of Ocean Engineering and Technology, vol. 23, No. 1, Jan. 1, 2009 (Jan. 1, 2009), pp. 24-30, XP093054871, ISSN: 1225-0767.

*Primary Examiner* — Marc Q Jimenez
*Assistant Examiner* — Jovon E Hayes
(74) *Attorney, Agent, or Firm* — Dinsmore & Shohl LLP; Yongsok Choi, Esq.

(57) ABSTRACT

The present invention relates to a method for acquiring location information of an observation buoy reflecting influence of an ocean current and a method for assessing damage risk relating to spilled oil dispersion of a sunken ship by using same location information. At least one small observation buoy is floated on a target sea area, and a relay buoy collects location information from the observation buoy and predicts ocean current distribution of the target sea area on the basis of the collected information; and the predicted ocean current distribution is applied to a step of predicting spilled oil dispersion in a surrounding sea area so that damage risk relating to spilled oil dispersion of a sunken ship is precisely assessable.

5 Claims, 12 Drawing Sheets

(56) References Cited

FOREIGN PATENT DOCUMENTS

| | | | | | |
|---|---|---|---|---|---|
| KR | 101567431 | B1 | * | 11/2015 | ..... G06Q 50/26 |
| KR | 10-2017-0098572 | A | | 8/2017 | |
| KR | 2017098572 | A | * | 8/2017 | ..... B63B 22/00 |
| KR | 10-2018-0034716 | A | | 4/2018 | |
| KR | 2018034716 | A | * | 4/2018 | ..... B63B 22/00 |
| KR | 2334171 | B1 | * | 2/2021 | ..... B63B 22/00 |
| KR | 102334171 | B1 | * | 12/2021 | ..... B63B 27/36 |

* cited by examiner

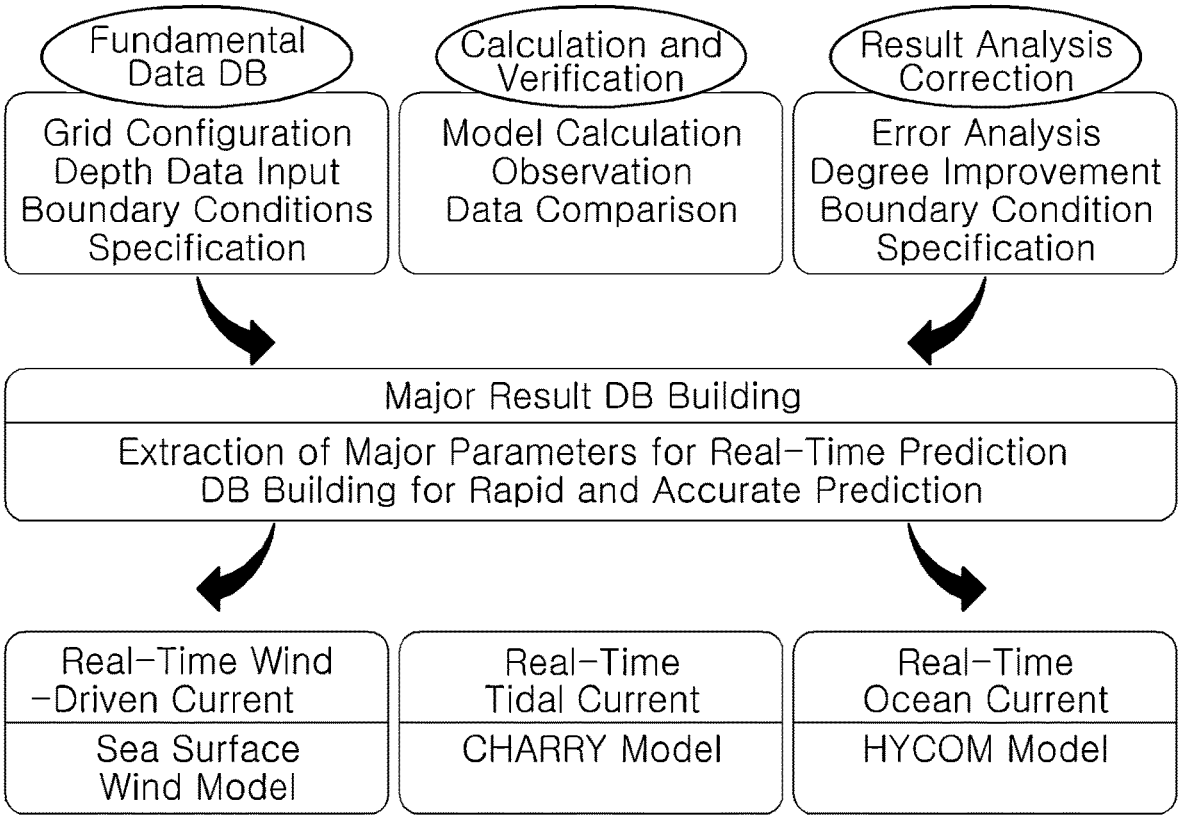
[FIG. 1]

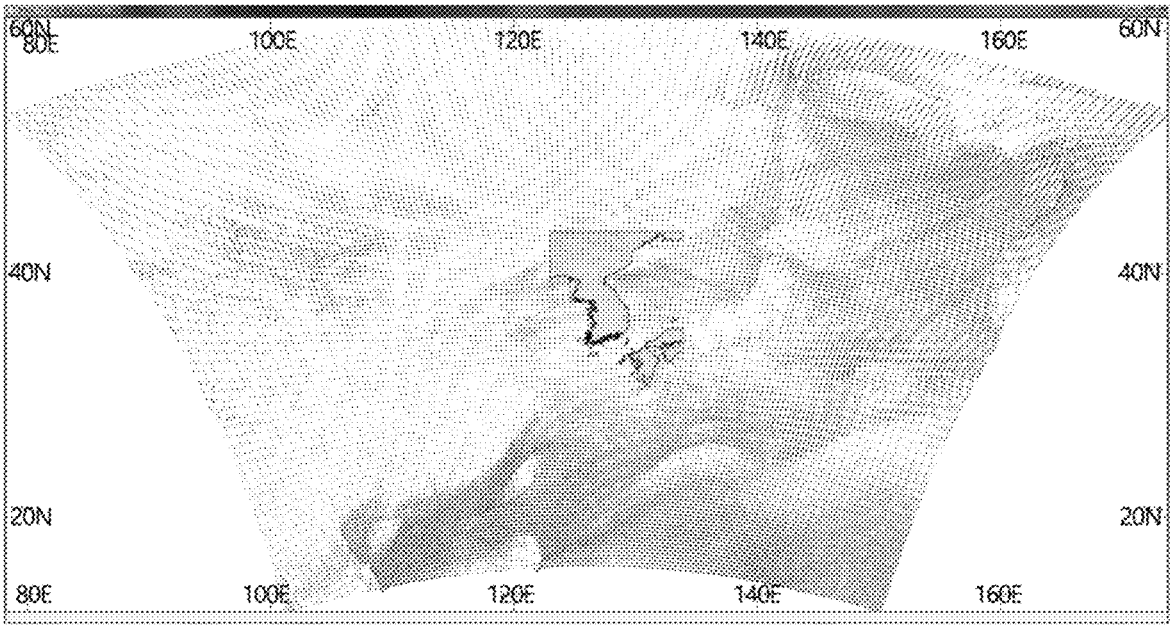
[FIG. 2]

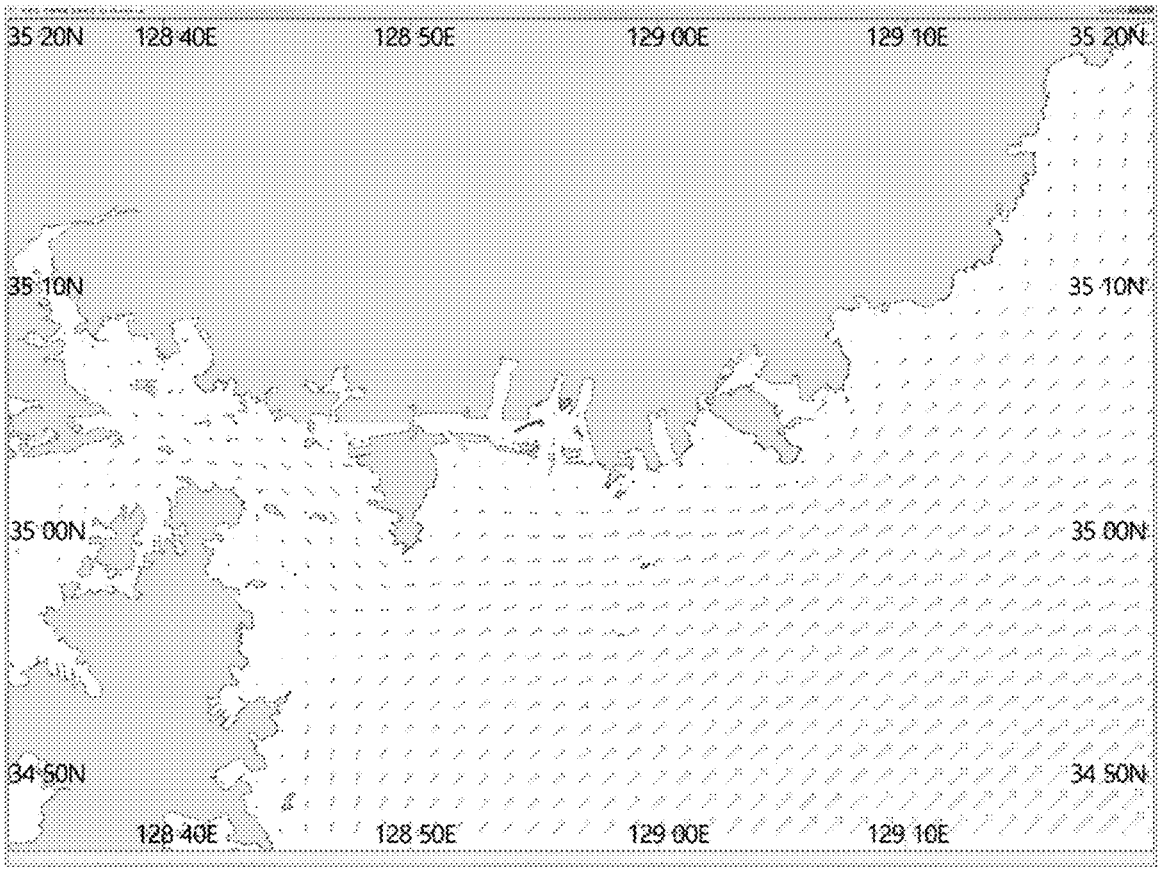
[FIG. 3]

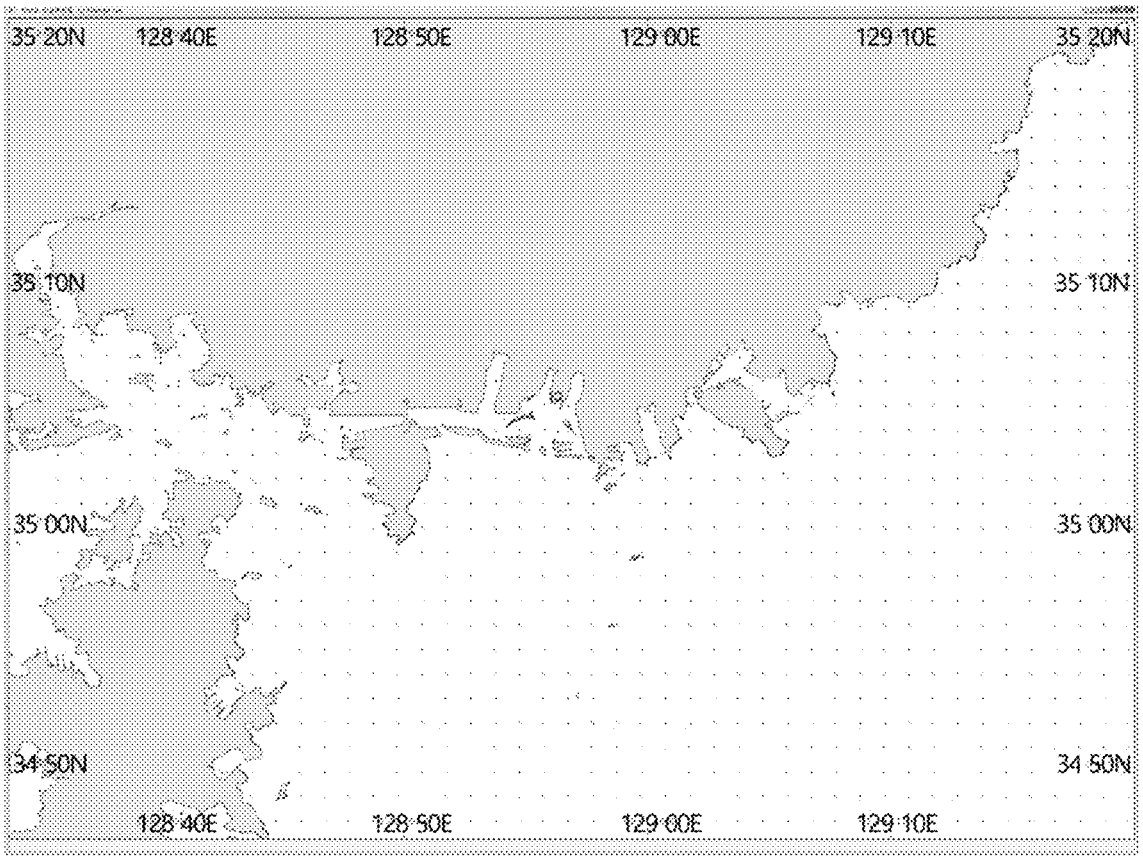
[FIG. 4]

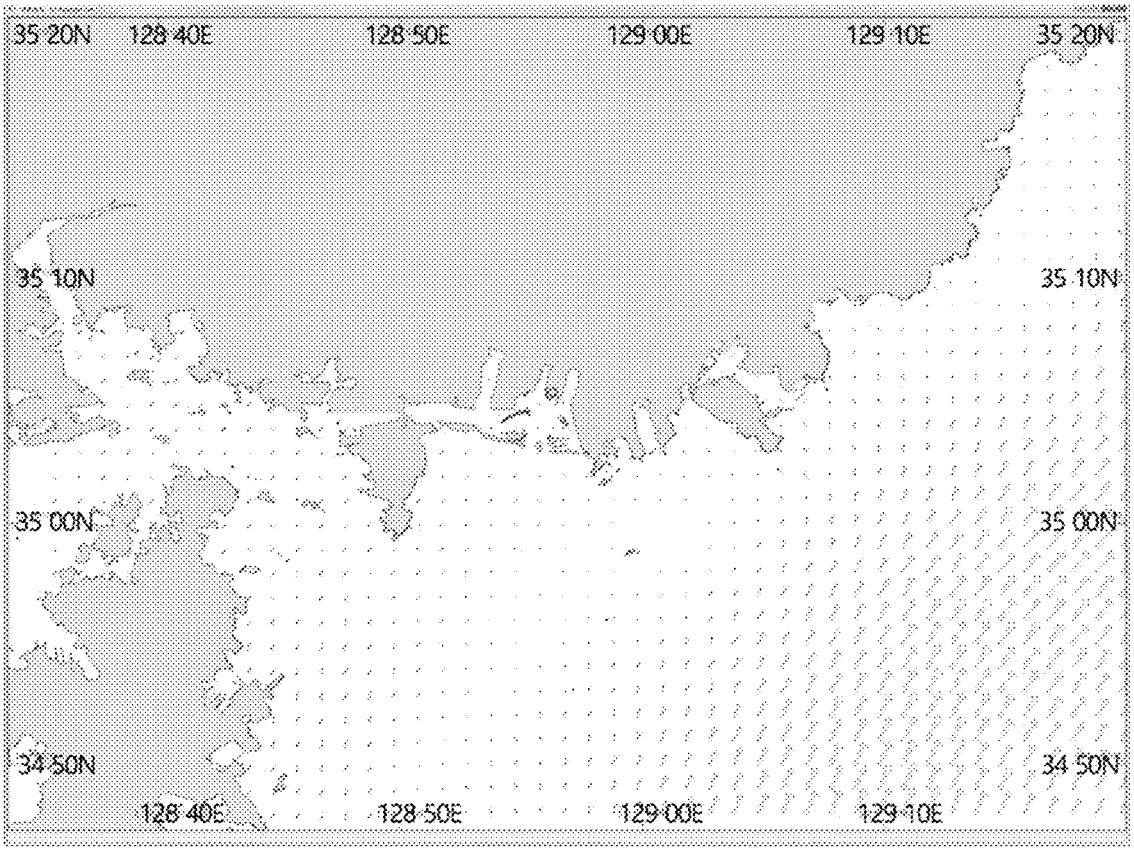
[FIG. 5]

[FIG. 6]
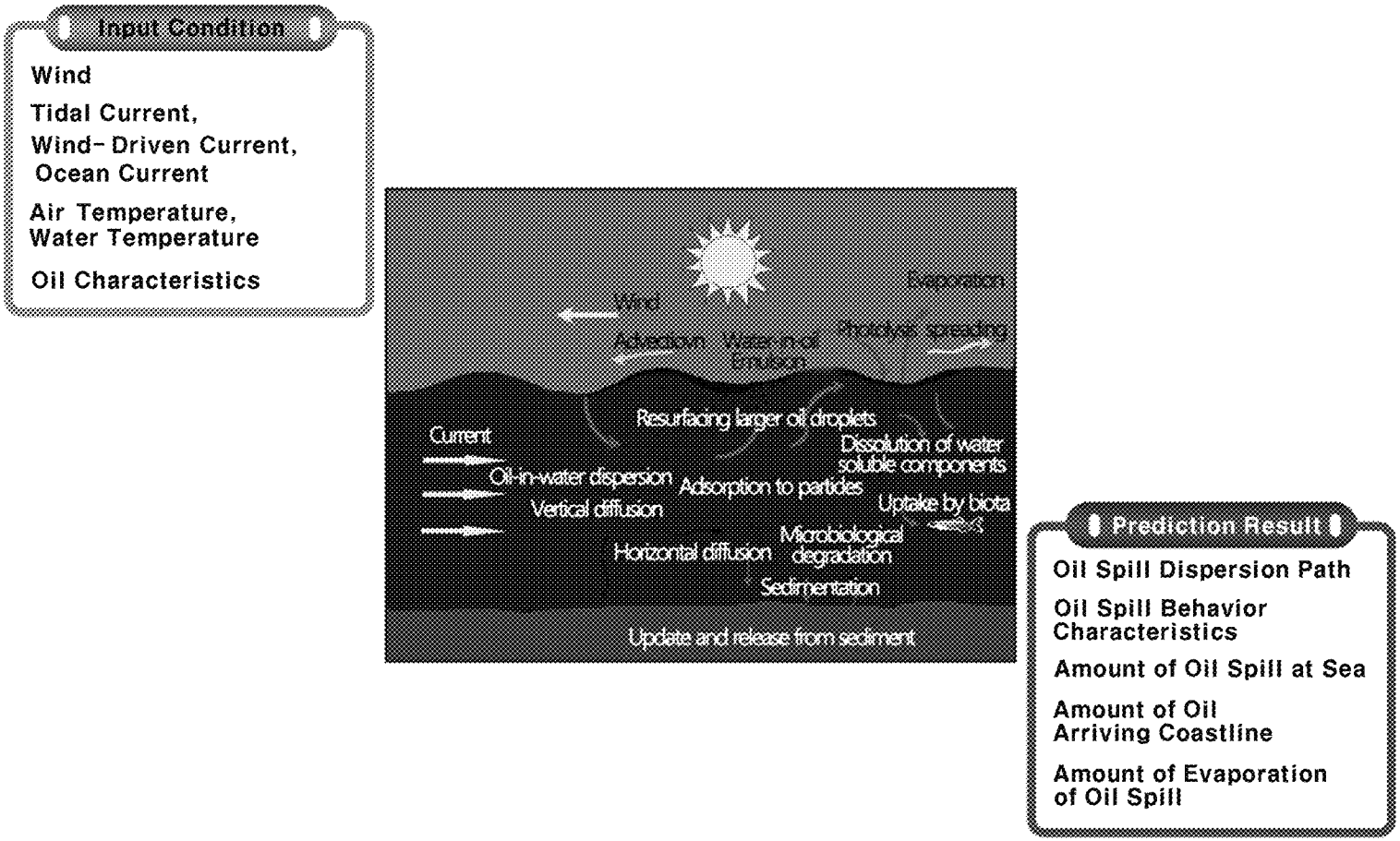

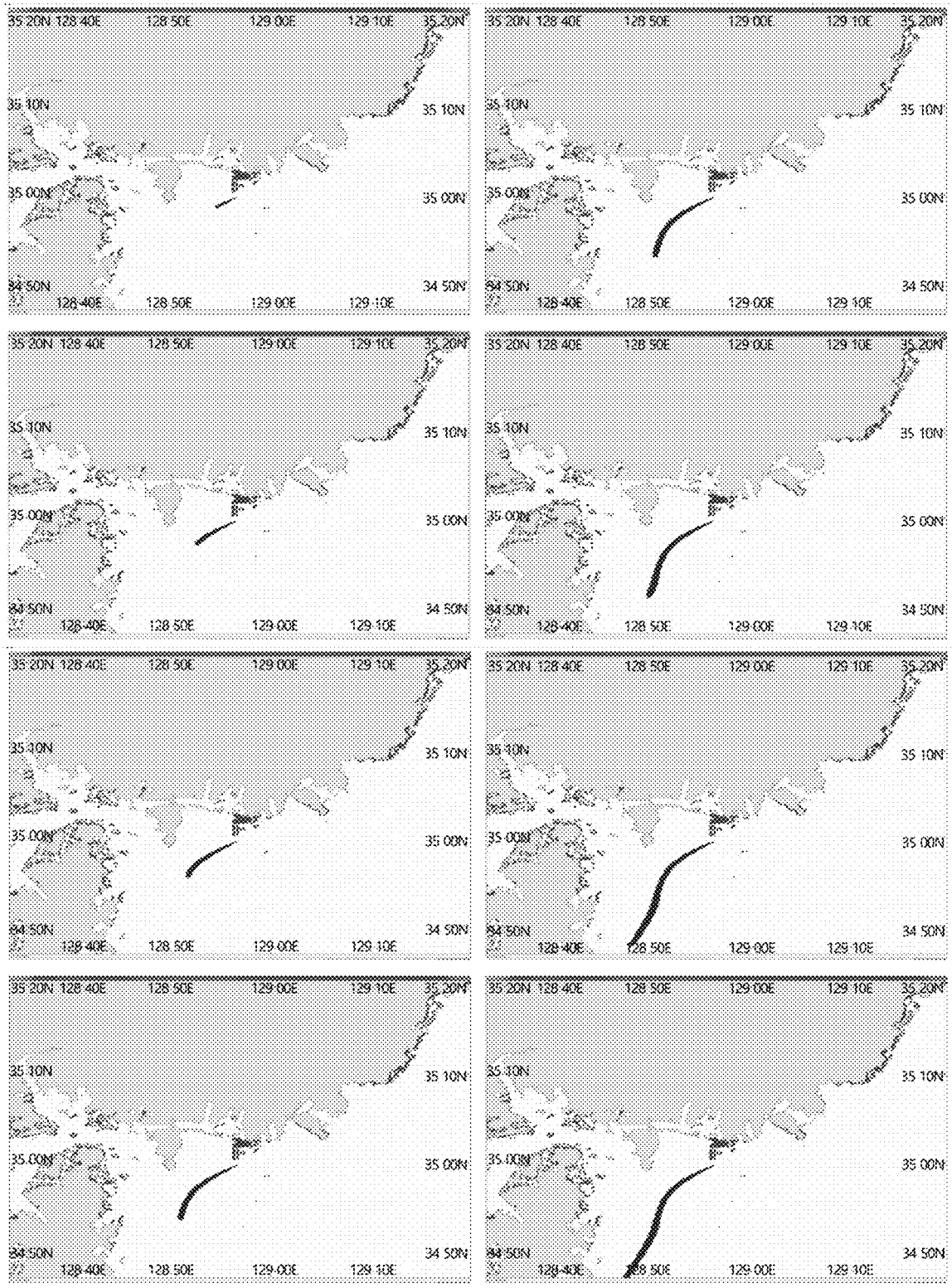
[FIG. 7]

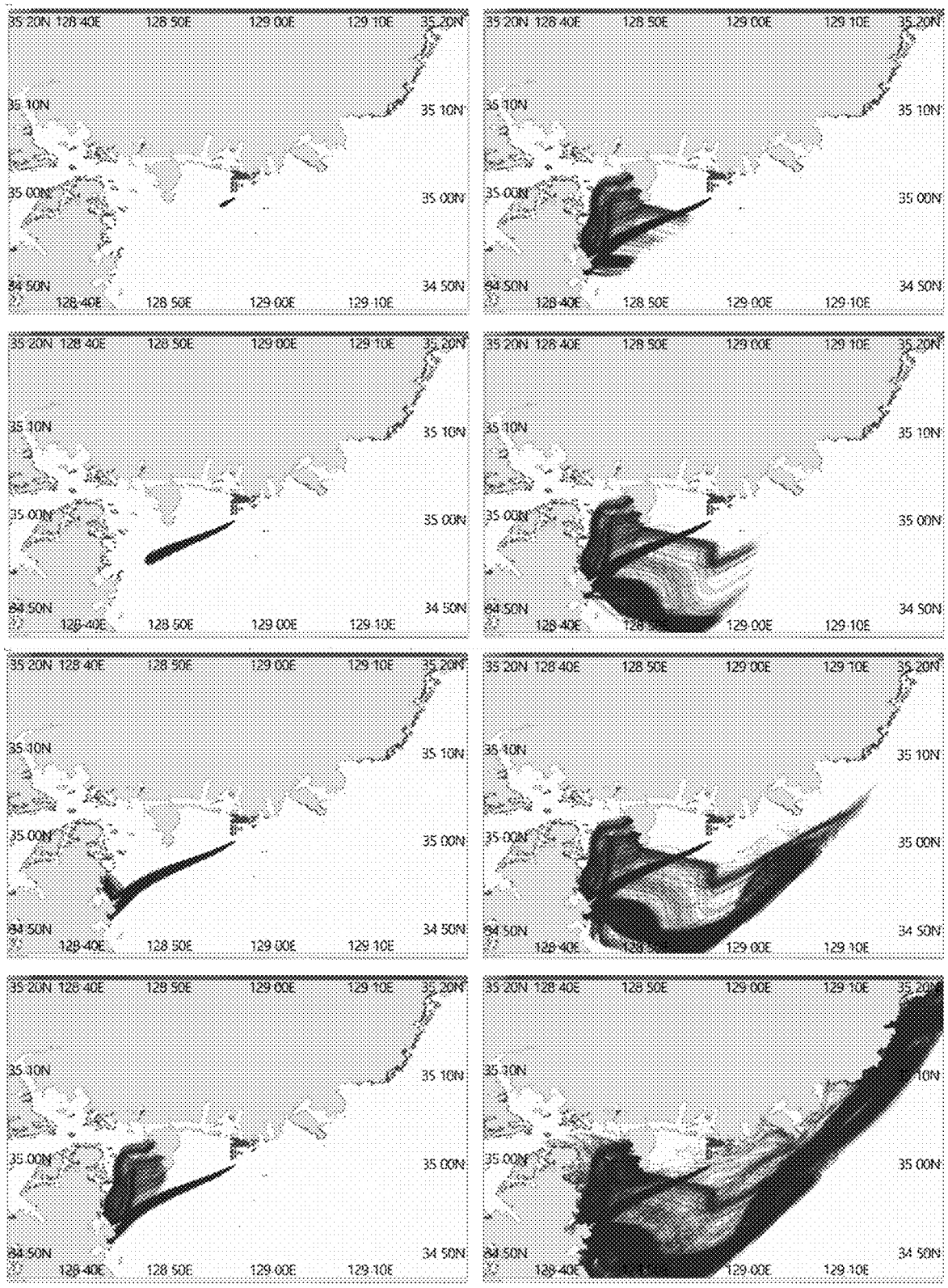
[FIG. 8]

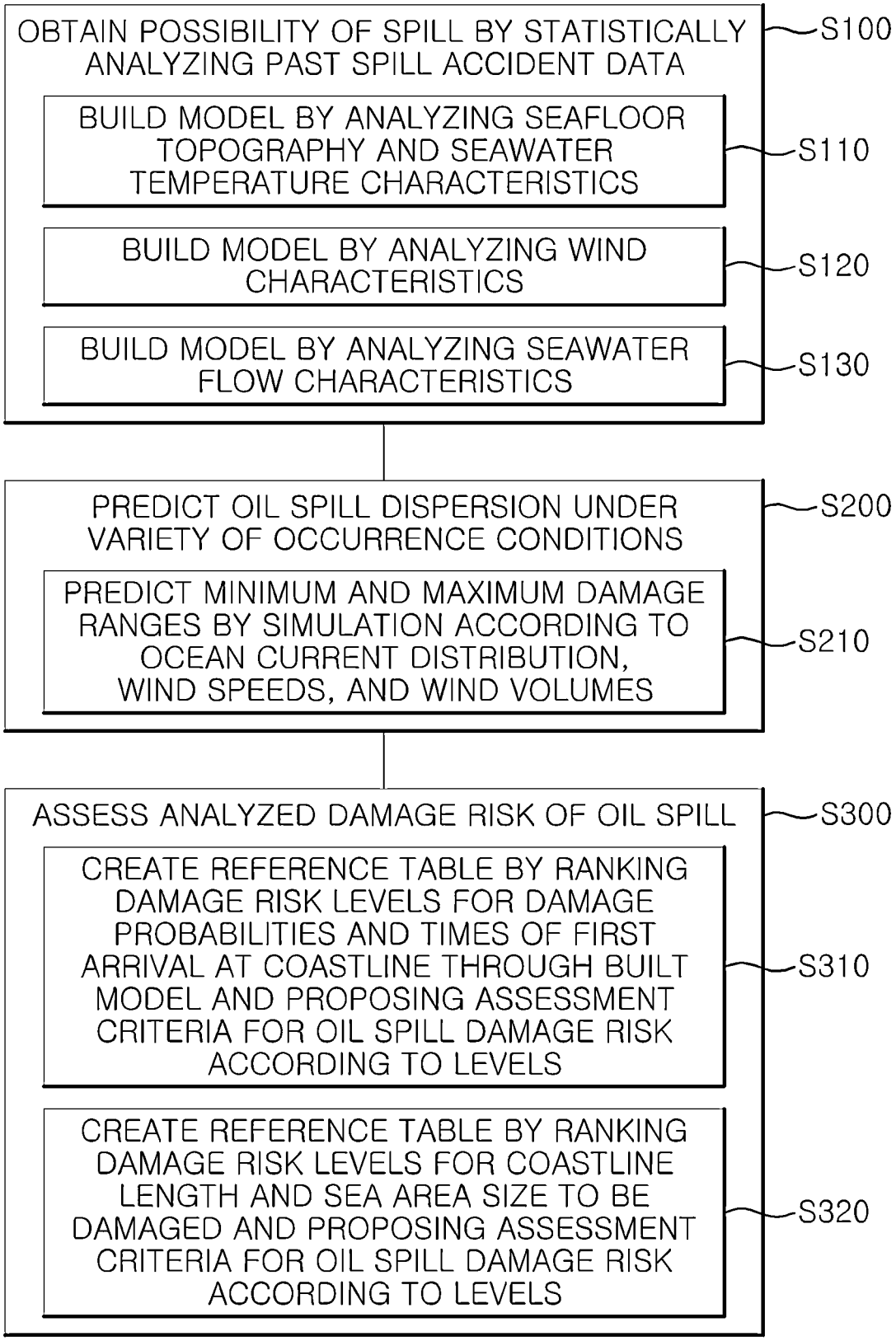
[FIG. 9]

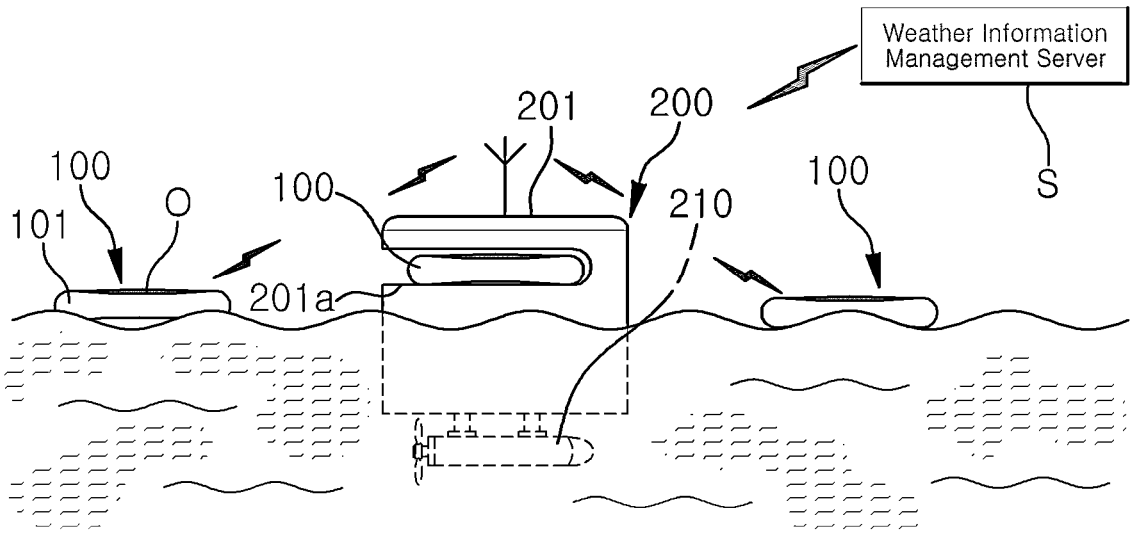
[FIG. 10]

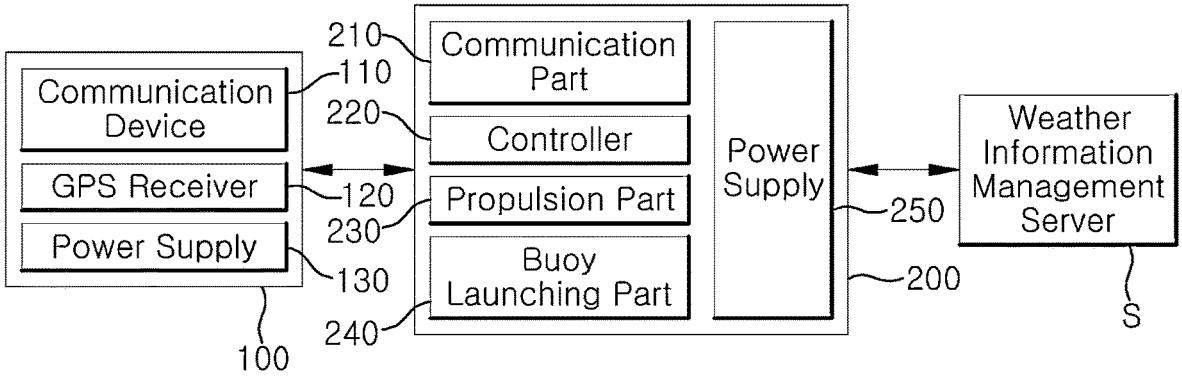
[FIG. 11]

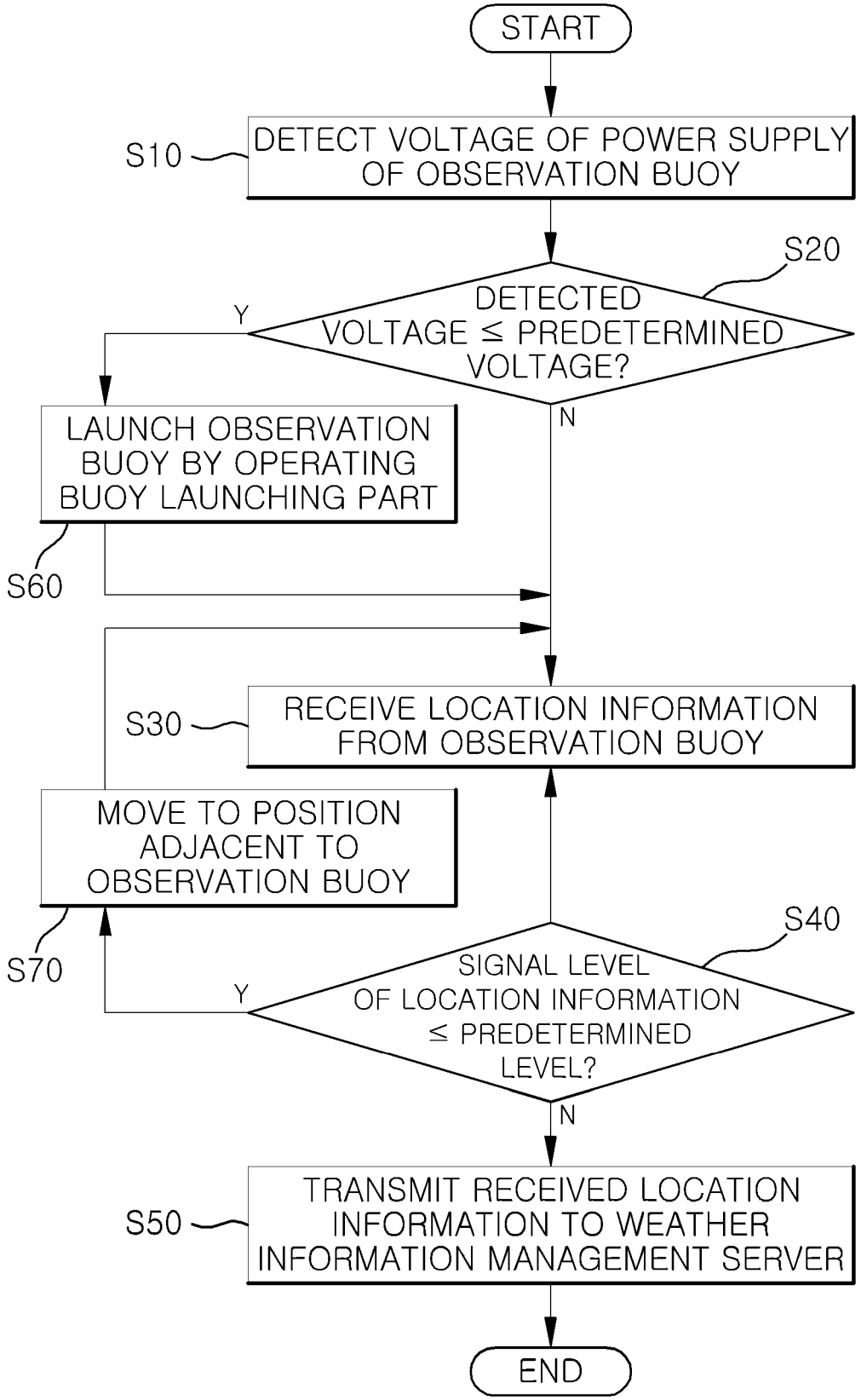
[FIG. 12]

METHOD FOR ACQUIRING LOCATION INFORMATION OF OBSERVATION BUOY REFLECTING INFLUENCE OF OCEAN CURRENT AND METHOD FOR ASSESSING DAMAGE RISK RELATING TO SPILLED OIL DISPERSION OF SUNKEN SHIP BY USING SAME LOCATION INFORMATION

CROSS-REFERENCE TO RELATED APPLICATIONS

This application is a continuation of International Application No. PCT/KR2022/014210 filed on Sep. 22, 2022, which claims priority to Korean Patent Application No. 10-2021-0127356 filed on Sep. 27, 2021, the entire contents of which are herein incorporated by reference.

TECHNICAL FIELD

The present disclosure relates to a method of obtaining location information of an observation buoy reflecting the influence of an ocean current and a method of assessing a damage risk relating to oil spill dispersion from a sunken ship using the location information and, more particularly, to a method of obtaining location information of an observation buoy reflecting the influence of an ocean current, wherein one or more small observation buoys are floated in a target sea area, a relay buoy collects location information from the observation buoys, and the ocean current distribution of the target sea area is predicted on the basis of the collected information, and a method of assessing a damage risk relating to oil spill dispersion from a sunken ship using the location information, wherein the predicted ocean current distribution is applied to a step of predicting oil spill dispersion in a surrounding sea area so that a damage risk relating to oil spill dispersion from a sunken ship is precisely assessable.

BACKGROUND ART

In general, in order to minimize the damage of marine pollution caused by maritime accidents, rapid first response, establishment of efficient control strategies, and rapid mobilization of control equipment are necessary.

Because oil spills at sea are spread by environmental forces, such as tidal currents, ocean currents, and winds, it is very important to accurately identify the spreading paths of oil spills by considering the real-time environmental forces at the time of the accident for efficient control.

Several theoretical and numerical analyses have been conducted to estimate the spreading paths of oil spills at sea, but most of such analyses only provide localized analyses of specific accidents.

Therefore, in Korean Patent No. 10-1567431 (hereinafter, referred to as a "related art"), a weather forecast system, a satellite image receiving system, a tide station, a server, and a client are connected to the Internet, wherein the server receives weather data, water temperature data, and tide information in real time from the weather forecast system, the satellite image receiving system, and the tide station, a tidal current and a wind-driven current are predicted using the weather data, the water temperature data, the tide information, and a seawater flow numerical model stored in the server, and a sea water flow is predicted using the tidal current and the wind-driven current, and oil spill dispersion is predicted in real time using the sea water flow and the weather data.

However, the related art only relies on the seawater flow numerical model such as weather, water temperature, and tides observed in real time. Thus, there is a problem in that damage is more serious when a correction is required at any time in response to incorrect data being input or when a spread range predicted in real time is different from the expected range.

Therefore, as a plan for recovering residual oil of the sunken ship is established, it is necessary to establish a spilled oil control method and an emergency response plan to prepare for a spill accident that may occur during the recovery operation, to establish an oil spill dispersion prediction model to prepare for a possible oil pollution accident that may occur during the operation of recovering residual oil of the sunken ship, and to accordingly assess the damage risk of an oil spill.

DISCLOSURE

Technical Problem

Accordingly, the present disclosure has been made keeping in mind the above problems occurring in the related art, and an objective of the present disclosure is to provide a method of obtaining location information of an observation buoy reflecting the influence of an ocean current, wherein the accuracy of an ocean current simulation may be improved by providing a weather information management server with location information of the observation buoy in which the effect of an actual ocean current is maximally reflected.

Another objective of the present disclosure is to provide a method of assessing a damage risk relating to oil spill dispersion from a sunken ship, wherein the damage risk of an oil spill occurring in the event of an actual sinking accident may be minimized by assessing the damage risk of an oil spill for a target sea area in a specific area where a sinking accident is likely to occur.

Technical Solution

In order to accomplish at least one of the above objectives, according to an embodiment of the present disclosure, provided is a method of obtaining location information of an observation buoy reflecting the influence of an ocean current, performed in target sea area by a location tracking device including one or more observation buoys and a relay buoy, the method including: step of detecting, by a relay buoy, a voltage of a power supply of an observation buoy; step of determining, by the relay buoy, whether a voltage of the power supply of the observation buoy is equal to or lower than a predetermined voltage; step of, when the voltage of the power supply of the observation buoy is higher the predetermined voltage in the voltage determination step, receiving, by the relay buoy, location information from the observation buoy; step of determining, by the relay buoy, whether a signal level of the location information is equal to or lower than a predetermined level; and step of, when the signal level of the location information is higher than predetermined level in the level determination step, determining, by the relay buoy, the received location information to be location information of an observation buoy in the target sea area and transmitting the location information to a weather information management server.

The method according to an embodiment of the present disclosure may further include, when the voltage of the power supply of the observation buoy is equal to or lower than the predetermined voltage in the voltage determination step, step of launching, by the relay buoy, a spare observation buoy stored therein to sea.

The method according to an embodiment of the present disclosure may further include, when the signal level of the location information is higher than predetermined level in the level determination step, step of moving the relay buoy to a position at a predetermined distance from the observation buoy.

In order to accomplish at least one of the above objectives, according to another embodiment of the present disclosure, provided is a method of assessing a damage risk relating to oil spill dispersion from a sunken ship to predict oil spill dispersion from a sunken ship in a target sea area and asses a damage of the oil spill dispersion using location information of an observation buoy in the target sea area obtained by the above-described method of obtaining location information of an observation buoy reflecting the influence of an ocean current recited in, the assessing method including: determination step of determining a possibility of a spill accident by statistical analysis, the determination step including a step of building a model by randomly selecting a spill time in the target sea area and analyzing seafloor topography and seawater temperature characteristics, a step of building a model by analyzing wind characteristics, and a step of building a model by analyzing seawater flow characteristics; spill dispersion prediction step of predicting oil spill dispersion in a surrounding sea area by repeatedly performing simulations according to seafloor topography, seawater temperature, wind, and seawater flow characteristics conditions; and assessment step of assessing a damage risk of an oil spill for the surrounding area by analyzing the predicted oil spill dispersion, wherein the spill dispersion prediction step includes step of predicting minimum and maximum damage ranges by obtaining an ocean current distribution of the target sea area based on the location information of the observation buoy in the target sea area and simulating an amount of oil spilled from the sunken ship and a coastline length and a sea area size to be damaged per unit of elapsed time by applying an ocean current distribution, wind speeds, and wind volumes of the target sea area in the built model.

In the method according to another embodiment of the present disclosure, the assessment step may include: first assessment step of creating a reference table by ranking damage risk levels for damage probabilities and times of first arrival at a coastline based on the built model and proposing assessment criteria for the damage risk of the oil spill according to the levels; and second assessment step of creating a reference table by ranking damage risk levels for the coastline length and the sea area size to be damaged and proposing assessment criteria for the oil spill damage risk according to the levels.

Advantageous Effects

The method of obtaining location information of an observation buoy reflecting the influence of an ocean current according to an embodiment of the present disclosure is configured to: detect, by a relay buoy, a voltage of a power supply of an observation buoy; determine, by the relay buoy, whether or not the voltage of the power supply of the observation buoy is equal to or lower than a predetermined voltage, and when the voltage of the power supply of the observation buoy is higher than the predetermined voltage, receiving, by the relay buoy, location information from the observation buoy; and determine, by the relay buoy, whether a signal level of the location information is equal to or lower than a predetermined level, and when the signal level of the location information is higher than the predetermined level in the determination of the signal level, determine the received location information to be location information of the observation buoy of the target sea area and transmit the location information of the observation buoy to a weather information management server, wherein the location information of the observation buoy maximally reflecting the influence of an actual ocean current may be provided to the weather information management server, thereby improving the accuracy of an ocean current simulation.

The method of assessing a damage risk relating to oil spill dispersion from a sunken ship according to another embodiment of the present disclosure is configured to: determine a possibility of a spill accident by statistical analysis, the determination comprising a step of building a model by randomly selecting a spill time in the target sea area and analyzing seafloor topography and seawater temperature characteristics, a step of building a model by analyzing wind characteristics, and a step of building a model by analyzing seawater flow characteristics; predict oil spill dispersion in a surrounding sea area by repeatedly performing simulations according to seafloor topography, seawater temperature, wind, and seawater flow characteristics conditions; and assess a damage risk of an oil spill for the surrounding area by analyzing the predicted oil spill dispersion, wherein in the spill dispersion prediction, minimum and maximum damage ranges are predicted by obtaining an ocean current distribution of the target sea area based on the location information of the observation buoy in the target sea area and simulating an amount of oil spilled from the sunken ship and a coastline length and a sea area size to be damaged per unit of elapsed time by applying an ocean current distribution, wind speeds, and wind volumes of the target sea area in the built model. In this manner, the damage risk of an oil spill occurring in the event of an actual sinking accident may be minimized by assessing the damage risk of an oil spill for a target sea area in a specific area where a sinking accident is likely to occur.

DESCRIPTION OF DRAWINGS

FIG. 1 is a schematic view illustrating a hydrodynamic model used in a method of assessing a damage risk relating to oil spill dispersion from a sunken ship according to embodiments of the present disclosure.

FIG. 2 illustrates a weather forecast model used in the method of assessing a damage risk relating to oil spill dispersion from a sunken ship according to embodiments of the present disclosure.

FIG. 3 is a real-time tidal current prediction view of a target sea area used in the method of assessing a damage risk relating to oil spill dispersion from a sunken ship according to embodiments of the present disclosure.

FIG. 4 is a real-time wind-driven current prediction view used in the method of assessing a damage risk relating to oil spill dispersion from a sunken ship according to embodiments of the present disclosure.

FIG. 5 is a real-time ocean current prediction view used in the method of assessing a damage risk relating to oil spill dispersion from a sunken ship according to embodiments of the present disclosure.

FIG. 6 is a schematic view illustrating an oil spill dispersion model used in the method of assessing a damage risk relating to oil spill dispersion from a sunken ship according to embodiments of the present disclosure.

FIG. 7 is a view illustrating the result of a minimum damage scenario of oil spill dispersion predicted in an embodiment of the method of assessing a damage risk relating to oil spill dispersion from a sunken ship according to embodiments of the present disclosure.

FIG. 8 is a view illustrating the result of a maximum damage scenario of oil spill dispersion predicted in an embodiment of the method of assessing a damage risk relating to oil spill dispersion from a sunken ship according to embodiments of the present disclosure.

FIG. 9 is a flowchart illustrating the method of assessing a damage risk relating to oil spill dispersion from a sunken ship according to embodiments of the present disclosure.

FIG. 10 is a schematic view illustrating a location tracking device disposed in a target sea area to realize a method of obtaining location information of an observation buoy reflecting the influence of an ocean current according to embodiments of the present disclosure.

FIG. 11 is a block view illustrating the configuration of the location tracking device illustrated in FIG. 10.

FIG. 12 is a flowchart illustrating the method of obtaining location information of an observation buoy reflecting the influence of an ocean current according to embodiments of the present disclosure.

DETAILED DESCRIPTION

In the following description of the present disclosure, a detailed description of related known functions or elements will be omitted in the situation in which the subject matter of the present disclosure may be rendered unclear thereby. Terms described hereinafter are defined in consideration of functions thereof in the present disclosure, and may be varied according to the intention of a user or an operator, customs, and the like. Therefore, these terms should be defined on the basis of the contents of the entire specification. Terms used in the detailed description are intended only to describe embodiments of the present disclosure and thus should not be construed as being limiting. Unless the context clearly indicates otherwise, singular forms are intended to include plural forms. Herein, it should be understood that the term "include" or "comprise" or a derivative thereof is intended to indicate certain features, numbers, steps, operations, or components or a part or combination thereof, but does not exclude the possibility of the presence or addition of one or more other features, numbers, steps, operations, or components or a part or a combination thereof.

In each of the devices shown in the drawings, in some cases, components may have the same or different reference numbers to indicate that the components shown may be different or similar. However, the components may have different implementations to work with some or all of devices shown or described herein. A variety of components illustrated in the drawings may be the same or different. A first component may be referred to as a second component, and the second component may be referred to as the first component.

As used herein, a component "transmitting", "delivering", or "providing" data or signals to another component includes not only the component directly transmitting the data or signals to the other component, but also the component indirectly transmitting the data or signals to the other component through at least one third component.

Hereinafter, embodiments of the present disclosure will be described in detail with reference to the drawings.

[Method of Obtaining Location Information of Observation Buoy Reflecting Influence of Ocean Current]

FIG. 10 is a schematic view illustrating a location tracking device disposed in a target sea area to realize a method of obtaining location information of an observation buoy reflecting the influence of an ocean current according to embodiments of the present disclosure, and FIG. 11 is a block view illustrating the configuration of the location tracking device illustrated in FIG. 10.

As illustrated in FIGS. 10 and 11, the location tracking device for realizing the method of obtaining location information of an observation buoy reflecting the influence of an ocean current according to embodiments of the present disclosure includes one or more observation buoys 100 and a relay buoy 200.

Each of the observation buoys 100 includes a rubber tube 101, the body of which is filled with oil 0, in order to maximally reflect the effect of ocean currents at sea. Each of the observation buoys 100 includes a GPS receiver 120, a communication device 110, and a power supply 130.

The GPS receiver 120 serves to generate location information by receiving signals received from a plurality of GPS satellites.

The communication device 110 wirelessly communicates with the relay buoy 200 using short-range wireless communication technology such as Bluetooth, Wi-Fi, wireless location area network (WLAN), near field communication (NFC), and infrared communication technology. The communication device 110 provides the relay buoy 200 with the location information generated by the GPS receiver 120 using the short-range wireless communication technology. Because the communication device 110 is implemented as a short-range wireless communication module, the communication device 110 is lightweight.

The power supply 130 serves to provide the GPS receiver 120 and the communication device 110 with driving power, is implemented as a battery, and is lightweight.

Because each of the observation buoys 100 includes lightweight components as described above, the observation buoys 100 may move by maximally reflecting the effect of ocean currents at sea.

The relay buoy 200 serves to receive the location information from the one or more observation buoys 100 while floating at sea and provide a weather information management server S with the received location information. The relay buoy 200 is heavier than each of the observation buoys 100 and is not required to be influenced by ocean currents, and thus may be mounted with necessary observation equipment.

The relay buoy 200 includes a communication part 210, a buoy launching part 240, a propulsion part 230, a controller 220, and a power supply 250.

The communication part 210 wirelessly communicates with the one or more observation buoys 100 and the weather information management server S. The communication part 210 may communicate with the observation buoys 100 using short-range wireless communication technology such as Bluetooth, Wi-Fi, WLAN, NFC, and infrared communication technology, and may communicate with the weather information management server S using long-range wireless communication technology such as WiMAX, WLAN, CDMA, GSM, LTE-maritime (LTE-M), 3G, 4G, 5G, and LoRa (long range), and the communication method is not specifically limited.

The buoy launching part 240 is controlled by the controller 220, and serves to launch a spare observation buoy 100 stored in an observation buoy storage part 201*a* of a relay buoy body 201 to the sea. The spare observation buoy 100 is launched at a time point at which the voltage of the power supply 130 of an observation buoy 100 close to the relay buoy 200 drops to a predetermined voltage or lower.

The propulsion part 230 is disposed below or on a side of the relay buoy 200 to generate propulsion, thereby moving the relay buoy 200 at sea. When the signal level of the location information generated by one of the observation buoys 100 is equal to or lower than a predetermined level, the propulsion part 230 generates propulsion to move to a position close to the observation buoy (i.e., a position at a predetermined distance from the observation buoy), and the operation is controlled by the controller 220.

The controller 220 is a microprocessor controlling the entire operation of the relay buoy 200. When the voltage of the power supply 130 of one or more observation buoys 100 is detected to be equal to or lower than the predetermined voltage level, the controller 220 operates the buoy launching part 240 to launch the spare observation buoy 100 stored in the observation buoy storage part 201*a* of the relay buoy body 201 to the sea. When the signal level of the location information of the observation buoy 100 is detected to be equal to or lower than the predetermined voltage level, the controller 220 controls the propulsion part 230 to move the relay buoy 200 to a position at the predetermined distance from the observation buoy 100.

The power supply 250 serves to supply drive power to the communication part 210, the buoy launching part 240, the propulsion part 230, and the controller 220, but the configuration thereof is not specifically limited as long as photovoltaic cells or batteries are available and drive power is generated.

The method of obtaining location information of an observation buoy reflecting the influence of an ocean current having the above-described configuration according to embodiments of the present disclosure will be described with reference to the drawings.

FIG. 12 is a flowchart illustrating the method of obtaining location information of an observation buoy reflecting the influence of an ocean current according to embodiments of the present disclosure, in which S indicates a step.

Before describing the method of obtaining location information of an observation buoy reflecting the influence of an ocean current, it will be assumed that the one or more observation buoys 100 are floating in the target sea area and the single relay buoy 200 is floating close to the observation buoys 100.

First, the relay buoy 200 detects a voltage of the power supply 130 of the observation buoy 100 in S10 and determines whether or not the detected voltage is equal to or lower than a predetermined voltage in S20.

When the voltage detected in step S20 is higher than the predetermined voltage (N), the relay buoy 200 receives location information from the observation buoy 100 in S30.

Afterwards, the relay buoy 200 determines whether or not the signal level of the location information transmitted from the observation buoy 100 is equal to or lower than a predetermined level in S40.

When the signal level of the location information is higher than the predetermined level (N in step S40), the relay buoy 200 determines the location information received from the observation buoy 100 to be the location information of the observation buoy and transmits the determined location information to the weather information management server S in S50.

Here, it should be noticed that the location information of the observation buoy of the target sea area transmitted to the weather information management server S is used later in a method of assessing a damage risk relating to oil spill dispersion from a sunken ship according to embodiments of the present disclosure.

When the voltage of the power supply 130 of the observation buoy 100 is equal to or lower than the predetermined voltage (Y in step S20), the relay buoy 200 launches the spare observation buoy 100 stored therein to the sea in S60 and then step S30 is performed.

When the signal level of the location information is equal to or lower than the predetermined level (Y in step S40), the relay buoy 200 moves to a position at a predetermined distance from the observation buoy 100 due to drive force generated by the propulsion part 230 in S70 and then step S30 is performed.

The method of obtaining location information of an observation buoy reflecting the influence of an ocean current according to embodiments of the present disclosure is configured to: detect, by a relay buoy, a voltage of a power supply of an observation buoy; determine, by the relay buoy, whether or not the voltage of the power supply of the observation buoy is equal to or lower than a predetermined voltage, and when the voltage of the power supply of the observation buoy is higher than the predetermined voltage, receiving, by the relay buoy, location information from the observation buoy; and determine, by the relay buoy, whether a signal level of the location information is equal to or lower than a predetermined level, and when the signal level of the location information is higher than the predetermined level in the determination of the signal level, determine the received location information to be location information of the observation buoy of the target sea area and transmit the location information of the observation buoy to a weather information management server, wherein the location information of the observation buoy maximally reflecting the influence of an actual ocean current may be provided to the weather information management server, thereby improving the accuracy of an ocean current simulation.

[Method of Assessing Damage Risk Relating to Oil Spill Dispersion from Sunken Ship]

The method of assessing a damage risk relating to oil spill dispersion from a sunken ship according to embodiments of the present disclosure will be described with reference to the drawings.

FIG. 9 is a flowchart illustrating the method of assessing a damage risk relating to oil spill dispersion from a sunken ship according to embodiments of the present disclosure, in which S indicates a step.

The method of assessing a damage risk relating to oil spill dispersion from a sunken ship according to embodiments of the present disclosure is a method of predicting oil spill dispersion from a sunken ship due to a sinking accident in a target sea area and assessing a risk.

First, the possibility of a spill in the target sea area is determined by statistically analyzing past sinking and oil spill accidents in S100, oil spill dispersion in a surrounding sea area is predicted under a variety of occurrence conditions in S200, and an oil spill damage risk for the surrounding sea area is assessed by analyzing the predicted oil spill dispersion in S300.

The above process will be described in more detail as follows.

[Step S100]

This step is a process of determining the possibility of a spill accident in the target sea area.

The coast near Yeongil Bay, Gyeongsangbuk-do, where an oil spill occurred at sea in the past due to the sinking of the Kyung Shin, is selected as a target sea area, and the characteristics of the target sea area are analyzed.

According to the characteristics analysis, water temperature characteristics of an expected sinking point are obtained as seawater temperature characteristics by analyzing the surface water temperature and water temperature data at a depth of 50 m and 100 m observed in every other month. The annual water temperature fluctuation at a depth of 50 m is about 3° C., and the annual water temperature fluctuation at a depth of 100 m is about 1.5° C. The average annual fluctuation is about 1.5° C. according to characteristics in which the water temperature in winter is higher than that in summer due to the mixing of the East Korean warm current and the North Korean cold current.

In the actual ocean, strong winds caused by gusts or typhoons may occur instantaneously, but in the southwest wind, i.e., the main wind, the wind speed of less than 4 m/sec was about 30%, which is the greatest portion of the wind speeds, and the wind speed of 4 m/sec to 8 m/sec was about 7%. These characteristics represent normal seasonal wind patterns in Pohang.

In addition, the database of the Korea Oil Spill Prediction System (KOSPS) of the Korea Coast Guard and the survey data of the Korea Hydrographic and Oceanographic Agency are used in analyzing and modeling the seawater flow characteristics of the target sea area.

The step S100 of determining the possibility of a spill accident includes step S110 of building a model by analyzing seafloor topography and seawater temperature characteristics, step S120 of building a model by analyzing wind characteristics, and step S130 of building a model by analyzing seawater flow characteristics.

The hydrodynamic modeling may be divided into tidal current modeling using tidal boundary conditions and wind-driven current modeling using surface boundary conditions, and a database of parameters required for real-time prediction may be built on the basis of the results of such hydrodynamic models.

Here, the tidal current is provided as tide and tidal current harmonic constants, and the wind-driven current is provided as a reaction function between the sea surface wind and the wind-driven current.

Basic equations used are a seawater flow equation and a continuation equation for the polar coordinate system, as shown below, to fully account for the spherical effects of the Earth.

$$\frac{\partial U}{\partial t}+\frac{U}{R\cos\phi}\frac{\partial U}{\partial \chi}+\frac{V}{R}\frac{\partial U}{\partial \phi}-\frac{UV\tan\phi}{R}-fV+\frac{kU\sqrt{(U^2+V^2)}}{D}+\frac{g}{R\cos\phi}\frac{\partial(\alpha\zeta-\beta\zeta_o)}{\partial \chi}-\frac{\tau_x}{\rho D}=0$$

$$\frac{\partial V}{\partial t}+\frac{U}{R\cos\phi}\frac{\partial V}{\partial \chi}+\frac{V}{R}\frac{\partial V}{\partial \phi}-\frac{U^2\tan\phi}{R}+fU+\frac{kV\sqrt{(U^2+V^2)}}{D}+\frac{g}{R}\frac{\partial(\alpha\zeta-\beta\zeta_0)}{\partial \phi}-\frac{\tau_\phi}{\rho D}=0$$

$$\frac{1}{R\cos\phi}\left[\frac{\partial}{\partial \chi}(DU)+\frac{\partial}{\partial \phi}(DV\cos\phi)\right]+\frac{\partial \zeta}{\partial t}=0$$

[t: time, x: longitude, φ: latitude, U: average vertical x-axis flow speed, v: average vertical φ-axis flow speed, g: gravitational acceleration, ζ: sea surface displacement, D: water depth, R: earth radius, f: Coriolis parameter (f=2ω sin φ), k: seabed friction coefficient (k=0.003), p: seawater density, α, β: tidal force coefficient, $\zeta_0$: equilibrium tide caused by tidal force, and $\tau_x$ and $\tau_\varphi$: wind stresses in x- and ϕ-axis directions]

The model computation uses an explicit scheme, and the derivative uses an angled derivative scheme.

Numerical errors are offset by applying a double sweep scheme at each computation step.

Intertidal treatment uses the Flather and Heaps treatment technique (1975).

The boundary conditions are divided into open sea boundary conditions and surface boundary conditions.

The open sea boundary conditions are applied to the tidal current calculation, and are specified as the following time variations of sea surface displacements for four major harmonic constituents ($M_2$, $S_2$, $K_1$, $O_1$) using the harmonic constants obtained from coastal observation tide levels.

$$\xi(t)=\sum_{k=1}^{4}A_{\xi_k}\cos(\omega_k-\varphi_{\xi_k})$$

[$\omega_k$: harmonic constituent frequency, $A_{\zeta_k}$ and $\varphi_{\zeta_k}$: sea surface displacement amplitude and phase]

The surface boundary conditions are applied to the wind-driven current calculation to specify the wind stress on the ocean surface.

$$\tau_u=\rho_a C_d|W_u|W_u$$

$$C_d=1.1\times10^{-3}\ [W<6\text{ m/s}]$$

$$C_d=(0.81+0.063W)\times10^{-3}\ [6\text{ m/s}<W<22\text{ m/s}]$$

[τ: wind stress, $\rho_a$: air density, $C_d$: drag coefficient, and W: wind speed]

For the above conditions, real-time connection to the sea area characteristic data is necessary, and it is necessary to build a database.

As illustrated in FIG. 2, the database of surface water temperature data is built using HYCOM data from the U.S. Navy's National Research Lab (NRL), in which data is collected by receiving water temperature data once a day by File Transfer Protocol (FTP) connection.

For the real-time connection of sea surface wind data, the super computer weather forecast model (UM model) data is used, in which the polar stereographic projection over the Northeast Asia around the Korean Peninsula has a 12 km grid coverage, and 72-hour data is updated twice a day using the FTP.

The update times of the data are 12:00 (for data from 09:00 on that day to 09:00 three days later) and 24:00 (for data from 21:00 on that day to 21:00 three days later).

For example, AWS observation data is received every minute and every hour by connection to real-time field observation data from the AWS, i.e., a cloud web service, and accuracy is improved by comparative verification with weather model data.

As illustrated in FIG. 3, in the real-time seawater flow prediction, a harmonic response to the reference yardstick (CHARRY) model is used for the tidal current to estimate modulation wave harmonic constants (amplitude and phase) according to the tidal form of the tide observed at a tide station, and the tidal correction factor between a calculated tidal harmonic constant of the numerical model grid point at the corresponding tide station and a modulation wave harmonic constant of the tide observed at the tide station is estimated.

Therefore, by correcting the numerical model calculated tidal harmonic constants using the tidal revision number, the real-time tide and tidal current may be predicted by applying the harmonic constant, and thus the tidal current of the expected sinking point in the target sea area may be predicted.

In addition, referring to FIG. 4, surface wind-driven current observations may be used in predicting the surface wind-driven current of the wind-driven current.

$$U=0.029\times W$$

$$\varphi=\Phi+18.6^\circ$$

[U: flow speed, φ: flow direction, W: wind speed, Φ: wind direction]

In predicting the internal wind-driven current, hourly wind-driven currents for 5 years may be predicted in the target sea area of the sinking point by applying a bridge model using the reaction function between the sea surface wind and the wind-driven current.

As illustrated in FIG. 5, in the ocean current, daily real-time ocean currents using HYCOM data are predicted by calibrating prediction results by connection to data such as XBT, CTD, ARGO, and satellite observations by including 33 layers and up to 5,500 m vertically, according to the daily ocean circulation data forecast up to 5 days after each day by connection in real time to the hybrid coordinate ocean model (HYCOM) of the US Navy model, and the hourly ocean currents for 5 years in the target sea area of the sinking point may be predicted.

In addition, oil spill dispersion modeling and weathering modeling according to the characteristics of spilled oil may be performed to build a spill dispersion model.

First, the oil spill dispersion modeling may be performed for oil spill dispersion on the basis of a numerical tracer method.

Therefore, the location of the oil pollution spread model is tracked on the basis of the Monte Carlo method. When a particle placed at a position ($x_0$, $y_0$) at a time is moved by wind and a seawater flow to be placed at a position ($x_0+\delta x$, $y_0+\delta y$) after a time difference δt, the displacement (δx, δy) during δt is as follows.

$$\delta_x=(U+u')\delta_t$$

$$\delta_y=(V+v')\delta_t$$

[U, V: wind-driven seawater flow speed, u', v': turbulent flow speed]

That is, real-time seawater flow-based advective transport estimation may desirably use real-time tidal current, wind-driven current, and ocean current prediction results.

A fractal Brownian motion (fBm) based turbulent dispersion distance may be estimated by reflecting the spatial and temporal dispersion characteristics of an actual ocean turbulence field in order to reproduce fBm-based turbulent dispersion.

In the weathering modeling based on oil spill characteristics, the weathering according to the group of oil spill characteristics should be calculated.

Using data from the International Tanker Owners Pollution Federation Limited (ITOPF), oil spills are classified into four groups based on specific gravity, and the evaporation and emulsification processes of spilled oil are analyzed according to the group.

It can be seen that the volume of the residual oil in the sunken ship increases by about two times by emulsification immediately after the accident, and that only about 10% of the initial volume is evaporated after a few days from the occurrence of the accident, and about 50% of the initial volume is removed by evaporation after several weeks from the occurrence of the accident.

As illustrated in FIG. 6, the weathering calculation according to the oil spill type uses data available from the National Oceanic and Atmospheric Administration (NOAA) to model and analyze detailed characteristics of the emulsification of residual oil of the sunken ship, and the basic equation for the weathering is as below.

$$\frac{dQ}{dt}=-\alpha Q,\ \frac{dN}{dt}=-\alpha N$$

$$N(t)=N_0e^{-\alpha t}=N_0e^{-\frac{t}{t_e}}$$

$$N^{(n+1)}=N^{(n)}(1-\alpha\delta t)$$

[Q: total amount of spilled oil, N: number of numerical tracers, α: spilled oil reduction rate, t: time]

Therefore, for an oil reduction rate at sea, evaporation and emulsification rates according to the oil type may be applied using data from the NOAA, the ITOPF, and the like.

[Step S200]

The step S200 of predicting the oil spill dispersion in the surrounding sea area includes step S210 of predicting minimum and maximum damage ranges by obtaining the ocean current distribution of the target sea area based on the location information of the observation buoy in the target sea area obtained by the above method of obtaining location information of the observation buoy reflecting the influence of an ocean current (i.e., the location information transmitted to the server in step S50) and applying the ocean current distribution, wind speeds, and wind volumes of the target sea area in the built modeling to simulate the amount of oil spilled from the sunken ship and a coastline length and a sea area size to be damaged per unit of elapsed time.

For a possible oil spill scenario from a sunken ship and an oil spill dispersion simulation, a sunken ship accident likely to occur in the target sea area is selected as a scenario thereof, and the outline of the sinking accident of the sunken ship will be described below using the illustrations in FIGS. 7 and 8 as an example.

Ship type (tonnage): Cargo ship (2,945 tons)

Sinking date (ship age): Jun. 5, 1992 (22 years when sunk, 48 years today)

Sinking location: 35°00'01.31"N, 128°56'37.36"E

Depth (hull top depth): 33 m (24 m)

Damage: 15 m off port bow

Residual oil: HFO 129.8 kl to 182.2 kl

As a scenario of maximum residual oil spill, a simulation of residual oil spill dispersion from a sunken ship is performed by assuming that the total amount of residual oil spills due to the breakage of the old hull, the time of the spillage is indeterminable, the total amount of residual oil spills simultaneously at a depth of 33 m to 24 m, and the spilled oil rises to the sea surface immediately after the spillage.

Because the time of the spillage # is indeterminable, a spill at an unspecified time in the last five years is assumed. The time of the spillage is randomly selected by applying probabilities of equal spills by the hour of day, tide time, and season. In this manner, desirably, at least 500 spill dispersion simulations are performed by considering the reliability of the statistical analysis, and 10 days of dispersion are predicted for respective cases.

[Step S300]

The step of assessing the oil spill damage risk for the surrounding sea area includes step S310 of creating a reference table by ranking damage risk levels for damage probabilities and times of first arrival at the coastline through the built model and proposing assessment criteria for the oil spill damage risk according to the levels.

In addition, the step S300 includes step S320 of creating a reference table by ranking damage risk levels for the coastline length and the sea area size to be damaged and proposing assessment criteria for the oil spill damage risk according to the levels.

In estimating the damage range of the oil spill dispersion, a spill period is randomly selected from the last five years to calculate the range of the oil spill dispersion from the sunken ship for various environmental conditions and the path and range of dispersion for 10 days after the accident are simulated considering various environmental conditions more than 500 times in total, so that a sea area to be polluted, the length of coastline to be polluted, and the area of aquaculture farms to be polluted may be estimated on the basis of the range of dispersion in each case.

In order to assess the damage scale of the oil spill dispersion in which the outline of the sinking accident example is applied, minimum and maximum damage scales are assessed by statistically analyzing the damage scale for each case.

For example, the minimum and maximum damage scenarios for the sinking accident are selected as illustrated in the following table.

TABLE 1

Minimum and Maximum Damage Scenarios Selected for Target Sea Area

| | Minimum Damage Scenario | Maximum Damage Scenario |
|---|---|---|
| Date of Spill | Dec. 18, 2013, 05:57 | Sep. 1, 2014, 08:13 |
| Seasonal Characteristics | Winter, Dawn, Strongest High Tide | Summer, Morning, Strongest High Tide |
| Seawater Area Polluted (ha) | 3,575 | 135,137 |
| Coastline Length Polluted (km) | 0 | 140 |
| Area of Aquaculture Farms to be Polluted (ha) | 0 | 2,423 |

The above simulation is just an example implemented by selecting a target sea area, and a damage risk relating to an oil spill from a sunken ship may be assessed by repeatedly performing simulations in sea areas with a high probability of sinking, selected from among a variety of sea areas.

The method of assessing a damage risk relating to oil spill dispersion from a sunken ship according to embodiments of the present disclosure is configured to: determine a possibility of a spill accident by statistical analysis, the determination comprising a step of building a model by randomly selecting a spill time in the target sea area and analyzing seafloor topography and seawater temperature characteristics, a step of building a model by analyzing wind characteristics, and a step of building a model by analyzing seawater flow characteristics; predict oil spill dispersion in a surrounding sea area by repeatedly performing simulations according to seafloor topography, seawater temperature, wind, and seawater flow characteristics conditions; and assess a damage risk of an oil spill for the surrounding area by analyzing the predicted oil spill dispersion, wherein in the spill dispersion prediction, minimum and maximum damage ranges are predicted by obtaining an ocean current distribution of the target sea area based on the location information of the observation buoy in the target sea area and simulating an amount of oil spilled from the sunken ship and a coastline length and a sea area size to be damaged per unit of elapsed time by applying an ocean current distribution, wind speeds, and wind volumes of the target sea area in the built model. In this manner, the damage risk of an oil spill occurring in the event of an actual sinking accident may be minimized by performing oil spill damage risk assessment for a target sea area in a specific area where a sinking accident is likely to occur.

The exemplary embodiments are disclosed in the drawings and specification, and certain terms are used, but only to describe the embodiments of the present disclosure and not to limit their meaning or to limit the scope of the present disclosure as recited in the appended claims. A person having ordinary skill in the art will understand that various modifications and other equivalent embodiments are possible therefrom. Accordingly, the true scope of technical protection of the present disclosure should be defined by the appended claims.

The invention claimed is:

1. A method of obtaining location information of an observation buoy reflecting influence of an ocean current, performed in target sea area by a location tracking device comprising one or more observation buoys (100) and a relay buoy (200), the method comprising:

step (S10) of detecting, by a relay buoy (200), a voltage of a power supply (130) of an observation buoy (100);

step (S20) of determining, by the relay buoy, whether a voltage of the power supply of the observation buoy is equal to or lower than a predetermined voltage;

step (S30) of, when the voltage of the power supply of the observation buoy is higher the predetermined voltage in the voltage determination step (S20), receiving, by the relay buoy, location information from the observation buoy;

step (S40) of determining, by the relay buoy, whether a signal level of the location information is equal to or lower than a predetermined level; and step (S50) of, when the signal level of the location information is higher than predetermined level in the level determination step (S40), determining, by the relay buoy, the received location information to be location information of an observation buoy in the target sea area and transmitting the location information to a weather information management server (S).

2. The method of claim 1, further comprising, when the voltage of the power supply of the observation buoy is equal to or lower than the predetermined voltage in the voltage determination step (S20), step (S60) of launching, by the relay buoy, a spare observation buoy stored therein to sea.

3. The method of claim 1, further comprising, when the signal level of the location information is higher than predetermined level in the level determination step (S40), step (S70) of moving the relay buoy to a position at a predetermined distance from the observation buoy.

4. A method of assessing a damage risk relating to oil spill dispersion from a sunken ship to predict oil spill dispersion from a sunken ship in a target sea area and asses a damage of the oil spill dispersion using location information of an observation buoy in the target sea area obtained by the method of obtaining location information of an observation buoy reflecting the influence of an ocean current recited in claim 1, the assessing method comprising:

determination step (S100) of determining a possibility of a spill accident by statistical analysis, the determination step comprising a step of building a model by randomly selecting a spill time in the target sea area and analyzing seafloor topography and seawater temperature characteristics, a step of building a model by analyzing wind characteristics, and a step of building a model by analyzing seawater flow characteristics;

spill dispersion prediction step (S200) of predicting oil spill dispersion in a surrounding sea area by repeatedly performing simulations according to seafloor topography, seawater temperature, wind, and seawater flow characteristics conditions; and assessment step (S300) of assessing a damage risk of an oil spill for the surrounding sea area by analyzing the predicted oil spill dispersion, wherein the spill dispersion prediction step (S200) comprises step (S210) of predicting minimum and maximum damage ranges by obtaining an ocean current distribution of the target sea area based on the location information of the observation buoy in the target sea area and simulating an amount of oil spilled from the sunken ship and a coastline length and a sea area size to be damaged per unit of elapsed time by applying an ocean current distribution, wind speeds, and wind volumes of the target sea area in the built model.

5. The method of claim 4, wherein the assessment step (S300) comprises:

first assessment step (S310) of creating a reference table by ranking damage risk levels for damage probabilities and times of first arrival at a coastline based on the built model and proposing assessment criteria for the damage risk of the oil spill according to the levels; and second assessment step (S320) of creating a reference table by ranking damage risk levels for the coastline length and the sea area size to be damaged and proposing assessment criteria for the damage risk of the oil spill according to the levels.

* * * * *